US006246019B1

(12) United States Patent
Nakamura et al.

(10) Patent No.: US 6,246,019 B1
(45) Date of Patent: Jun. 12, 2001

(54) MULTIDIRECTIONAL SWITCH AND COMPLEX TYPE SWITCH USING THE SAME

(75) Inventors: Takaya Nakamura; Yoshihiko Kamimura, both of Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/525,752

(22) Filed: Mar. 14, 2000

(30) Foreign Application Priority Data

Mar. 15, 1999 (JP) ..... 11-068156

(51) Int. Cl.[7] ..... H01H 25/04
(52) U.S. Cl. ..... 200/6 A; 200/5 R
(58) Field of Search ..... 200/4, 5 R, 6 R, 200/6 A, 16 R, 17 R, 18, 512, 517, 513, 516

(56) References Cited

U.S. PATENT DOCUMENTS 4,820,890 4/1989 Tamura et al. ..... 200/81.4
5,555,004 * 9/1996 Ono et al. ..... 345/161
5,632,453 * 5/1997 Maeda ..... 200/6 A
5,691,517 * 11/1997 Yamamoto et al. ..... 200/6 A
5,952,628 * 9/1999 Sato et al. ..... 200/4
6,080,941 * 6/2000 Yokobori ..... 200/6 A

* cited by examiner

*Primary Examiner*—Michael Friedhofer
(74) *Attorney, Agent, or Firm*—McDermott, Will & Emery

(57) ABSTRACT

A switch substrate (11) is provided on the upper surface with a pluralities of fixed contact points (11A, 11B), and a driving body (12) made of an elastic material is placed over the switch substrate (11). The driving body (12) is integrally formed of a center press portion (14) and a periphery press portion (17) corresponding respectively to the fixed contact points (11A and 11B). The periphery press portion (17) is provided on the bottom surface at the central end region with a first protrusion (18), the cross sectional end shape of which protrusion being round and making contact to the switch substrate (11). The first protrusion (18) works as a fulcrum separating the functions of center press portion (14) and periphery press portion (17) to be independent to each other. As a result, even when an operating force is given on the operating body (22) at a place somewhat deviating from a right targeted area, the operating force can surely bring only a targeted switch into ON-OFF operation.

22 Claims, 8 Drawing Sheets

MULTIDIRECTIONAL SWITCH AND COMPLEX TYPE SWITCH USING THE SAME

FIELD OF THE INVENTION

The present invention relates to a multidirectional switch for use in various electronic apparatus and a complex type switch using the multidirectional switch.

BACKGROUND OF THE INVENTION

Range of the operating functions is expanding and diversifying among various electronic apparatus developed recently. A cursor moving in a display or selection keys provided on a key board are increasingly used as means for selecting an operational function when using an apparatus. As a device for inputting signals in such apparatus, a switch having multiple functions is requested, in which switch one operating body can manage action of pluralities of switch elements. For satisfying the above needs, various types of multidirectional switches that can be operated in a number of directions have been proposed.

A conventional multidirectional switch is described in the following with reference to FIG. 12 through FIG. 15. FIG. 12 shows a cross sectional view of a conventional multidirectional switch, FIG. 13 is an exploded perspective view of the switch, FIG. 14 is a cross sectional view of the switch in a state when the operating body is being pressed at the center, FIG. 15 is a cross sectional view of the switch in a state when the operating body is being pressed at a peripheral place.

As shown in FIG. 12 and FIG. 13, the conventional switch comprises a switch substrate 1 provided on the upper surface with a pair of fixed contact points 1A for the center switch element and four pairs of fixed contact points 1B for the periphery switch elements disposed in the peripheral region; a driving body 2 placed on the switch substrate 1, which driving body 2 being formed of a base portion 2A of an almost-flat board shape, a center drive portion 2D having on the bottom surface a movable contact point 2B opposing to the fixed contact points 1A and connected at the bottom circumference with the base portion 2A by a dome-shaped connection portion 2C of thin wall thickness, and four periphery drive portions 2G disposed around the center drive portion 2D, each having on the bottom surface a movable contact point 2E opposing to the fixed contact points 1B, connected at the bottom circumference with the base portion 2A by a dome-shaped connection portion 2F of thin wall thickness.

An operating body 3 of a thick disc shape is making contact at the bottom center with the upper surface of the center drive portion 2D, and is provided with an engagement portion 3A for positioning surrounding side wall of the center drive portion 2D and a flange 3B protruding from the outer circumference, which flange 3B having a plurality of cuts 3C. A resin case 4 is having an opening 4B for allowing the operating body 3 to rise and a plurality of pillars 4A disposed on the reverse surface for engagement with a certain clearance to the cuts 3C.

In the normal state, clearance between the movable contact point 2B and the fixed contact points 1A is set to be smaller than the sum of a clearance B between the movable contact point 2E and the fixed contact points 1B plus a clearance C between the bottom surface of flange 3B of operating body 3 and the upper surface of periphery drive portion 2G. Namely, clearance A<(clearance B+clearance C).

FIG. 12 illustrates the above described structure in the neutral state. When the operating body 3 is pressed down at the center as indicated with an arrow mark in FIG. 14, the center drive portion 2D moves down with flexion of the connection portion 2C, and the movable contact point 2B contacts with the fixed contact points 1A. Thereby, the center switch element turns into ON state. At this state, since the sum of clearances B and C is greater than the clearance A, the movable contact point 2E does not contact with the fixed contact points 1B; the periphery switch elements remain in OFF state. As soon as the pressure applied on the operating body 3 is withdrawn, the operating body 3 is pushed up by the center drive portion 2D with an elastic restorative force of the connection portion 2C. Thus it restores the neutral state.

When the operating body 3 is pressed at a peripheral region as illustrated with an arrow mark in FIG. 15, the operating body 3 tilts guided by the cut 3C of flange 3B and the pillar 4A. The connection portion 2C flexes and the bottom circumferential surface of operating body 3 makes contact with the upper surface of periphery drive portion 2G. With a further press, the connection portion 2F flexes allowing the periphery drive portion 2G to go down, and the movable contact point 2E contacts with the fixed contact points 1B. Thus ON state is created with the periphery switch elements. At this time, since the movable contact point 2B is set to maintain a certain clearance against the fixed contact points 1A, the fixed contact points 1A are not connected. Thus the center switch element is kept in OFF state. As soon as the pressure applied on the operating body 3 is withdrawn, the operating body 3 is pushed up by the center drive portion 2D and the periphery drive portion 2G with the elastic restorative force of connection portions 2C and 2F, and moves upward guided by the pillar 4A of resin case 4. Thus it restores to the neutral state.

In the conventional switch, however, there has been a problem that in some cases both the center switch element and the periphery switch element are brought into ON state altogether at a same time, if an operating force intended to press the operating body 3 at the center dislocated somewhat towards peripheral area, or if pressed with too much force although pressed at a right place.

SUMMARY OF THE INVENTION

A switch of the present invention comprises a switch substrate provided with a center switch element and a periphery switch element, and a driving body provided with a center press portion and a periphery press portion that correspond to the respective switch elements, the driving body being placed above the switch substrate. A first protrusion is provided on the bottom surface of the periphery press portion. The protrusion works to separate respective functions of the center press portion and the periphery press portion.

With the above described configuration, even if an operating force intended at the center, or the periphery, of operating body is exerted in a place somewhat deviating from a right place, only a targeted switch, either the center switch element, or the periphery switch element, are surely put into ON-OFF operation.

DESCRIPTION OF THE PREFERRED EMBODIMENTS

Referring to FIG. 1 through FIG. 11, exemplary embodiments of the present invention is described in the following. (Embodiment 1)

Figure 1:
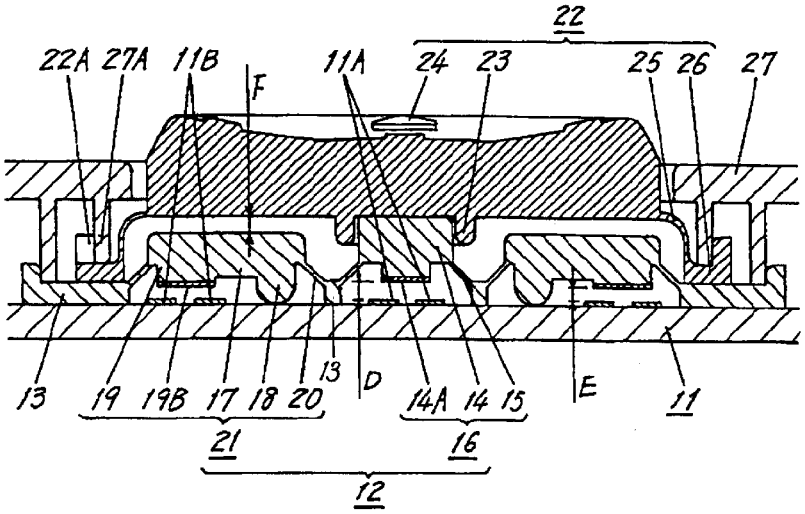
FIG. 1 is a cross sectional view of a multidirectional switch in a first exemplary embodiment of the present invention.
Figure 2:
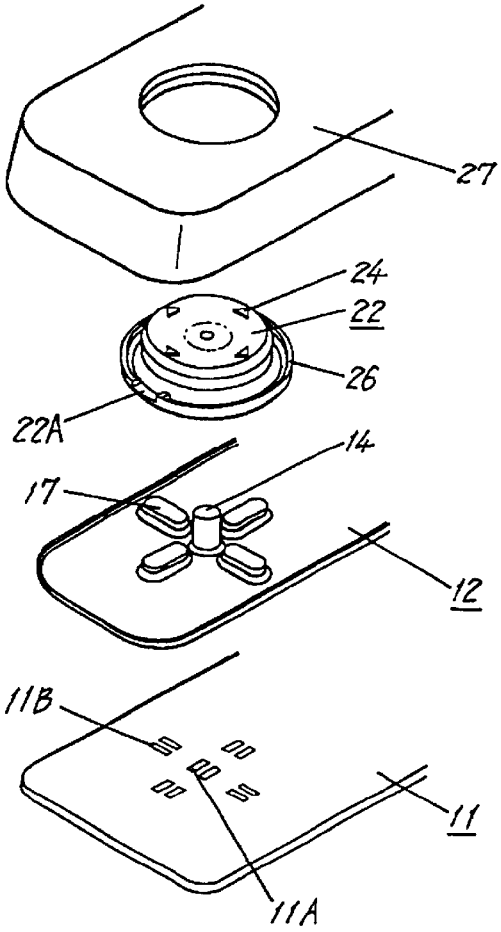
FIG. 2 is an exploded perspective view of the multidirectional switch.

As shown in FIG. 1 and FIG. 2, an insulating switch substrate 11 is provided with a pair of fixed contact points 11A for a center switch element at the center of the upper surface, and four sets of fixed contact points 11B for periphery switch elements around the fixed contact points 11A. These contact points are integrally formed with carbon ink, a metal foil, etc. at a same time when a circuit wiring (not shown) is formed.

A driving body 12 made of rubber, elastomer or the like elastic material is placed on the switch substrate 11. The driving body 12 is formed of a base portion 13 having a thick wall thickness and a center press portion 14 of thick column shape locating above the center fixed contact points 11A. On the bottom surface of the center press portion 14, a movable contact point 14A is formed by printing a carbon or the like material, which keeps a certain specific clearance D against the fixed contact points 11A.

The center press portion 14 is connected at the bottom circumference with the lower-positioned base portion 13 by a first connection portion 15 of an approximate dome shape having a thin wall thickness. Thus a center drive portion 16 is formed. Around the center drive portion 16, four periphery press portions 17 are provided in radial directions with an equal angular space of 90 degree, the periphery press portion 17 having an oblong shape with a thick wall thickness and the upper surface being located at a level lower by a certain specific value than the upper surface of the center press portion 14.

Each of the periphery press portion 17 is provided on the bottom surface with a first protrusion 18 at the central end, the first protrusion having a round end that makes contact with the upper surface of the switch substrate 11. The periphery press portion 17 is also provided on the bottom surface at the outer end with a second protrusion 19 having a flat end. On the bottom surface of the second protrusion 19, a movable contact point 19B is formed by printing a carbon or the like material keeping a certain specific clearance E against the fixed contact points 11B. The periphery press portion 17 is connected at the bottom circumference with the lower-positioned base portion 13 by a second connection portion 20 of an approximate dome shape having a thin wall thickness. Thus a periphery drive portion 21 is formed. An operating body 22 of rubber, elastomer or the like elastic material formed in a thick-wall disc shape is provided covering the whole upper surface of the driving body 12. There is a certain specific clearance F provided between the bottom surface of the operating body 22 and the upper surface of the periphery press portion 17.

The operating body 22 makes contact at the bottom center with the upper surface of the center press portion 14, and is provided with an engagement portion 23 surrounding the side wall of the center press portion 14 for the right positioning. On the upper surface of the operating body 22, four direction indicating marks 24 are formed. The operating body 22 is connected at the bottom circumference with a lower-positioned circumferential thick rim 26 by a third connection portion 25 having an approximate dome shape of thin wall thickness. The operating body 22 is thus placed on the base portion 13.

A resin case 27 is provided with an opening for allowing the operating body 22 to come upward, and a ridge 27A on the reverse surface. The operating body 22 has a cut 22A in the circumferential rim 26 for positioning in engagement with the ridge 27A of resin case 27. The operating body 22 is held at a right positioning, together with the base portion 13, towards the switch substrate 11 by the ridge 27A of resin case 27.

Clearance D between the movable contact point 14A and the fixed contact points 11A is set to be greater than the clearance E between the movable contact point 19B and the fixed contact points 11B; and clearance F between the bottom surface of operating body 22 and the upper surface of periphery press portion 17 is set to be greater than or equal to the clearance D. Namely, clearance F □ clearance D>clearance E.

Figure 3:
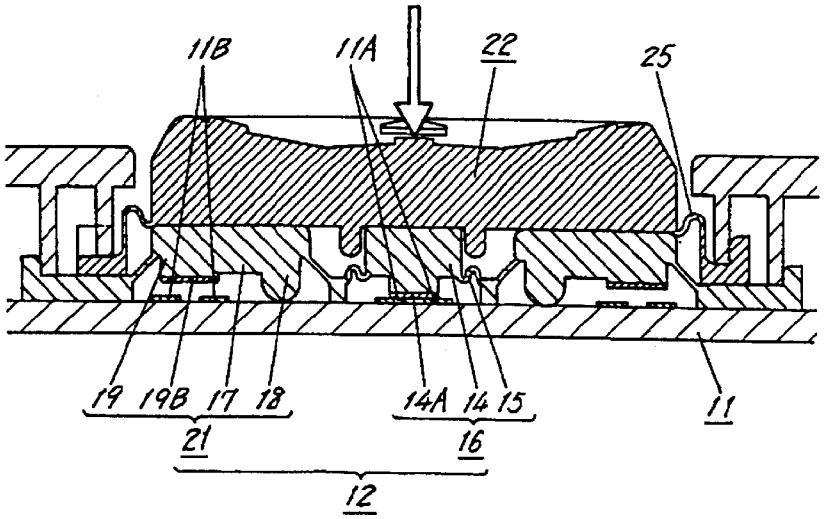
FIG. 3 is a cross sectional view of the multidirectional switch, in a state where the operating body is being pressed down at the center.

In the above described structure as illustrated in FIG. 1, which shows the neutral state, when the operating body 22 is pressed at the center as indicated with an arrow mark in FIG. 3, the third connection portion 25 flexes and the center press portion 14, which is in contact with the bottom surface of the operating body 22, is pushed downward with flexion of the first connection portion 15, and the movable contact point 14A contacts with the fixed contact points 11A. Thereby, the center switch element turns into ON state. At this state, although the clearance F between the periphery press portion 17 and the operating body 22 disappears, the movable contact point 19B disposed underneath stays as it is maintaining the clearance E against the fixed contact points 11B. Thus the periphery switch element stays in OFF state.

Even if further pressure is exerted on the operating body 22, the movable contact point 19B does not contact with the fixed contact points 11B and the periphery switch element is kept in OFF state, because influence of the pressure to the periphery press portion 17 is suppressed by the first protrusion 18 disposed on the bottom surface of periphery press portion 17 and making contact with the switch substrate 11 at the tip end; as a result, the second protrusion 19 is not pushed downward and the movable contact point 19B and the fixed contact points 11B remain separated keeping the OFF state.

As soon as the pressure applied on the operating body 22 is withdrawn, the operating body 22 returns upward smoothly by an elastic restorative force of the third connection portion 25, and the center press portion 14 is also released from the pressure and returns upward to the neutral position by an elastic restorative force of the first connection portion 15.

Figure 4:
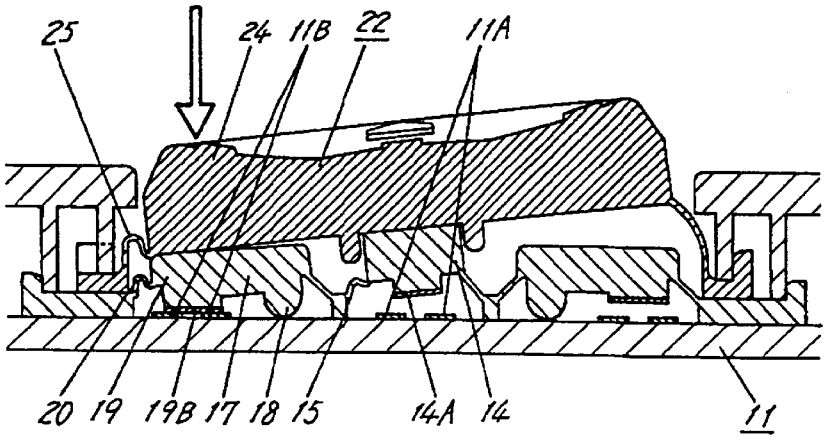
FIG. 4 is a cross sectional view of the multidirectional switch, in a state where the operating body is being pressed down at the periphery.

When the operating body 22 is pressed at the vicinity of one of the direction indicating marks 24 as illustrated with an arrow mark in FIG. 4, the third connection portion 25 flexes at one side while the other side elongates, and the whole operating body 22 tilts along the direction of pressure. As the result, the periphery press portion 17 is pressed downward by the bottom surface of operating body 22, the second connection portion 20 flexes, the second protrusion 19 makes revolving motion towards the switch substrate 11 with the tip end of first protrusion 18 as the fulcrum. The movable contact point 19B contacts with the fixed contact points 11B, and the periphery switch element turns into ON state. At this state, although the first connection portion 15 slightly flexes and the center press portion 14 tilts making the clearance D between movable contact point 14 and fixed contact points 11A smaller, still a certain clearance is preserved between the fixed contact points 11A and the movable contact point 14A enough to keep the center switch element in OFF state.

Even if further pressure is exerted on the operating body 22 at the place of direction indicating mark, the movable contact point 14A does not contact with the fixed contact points 11A and the center switch element is kept in OFF state, because influence of the pressing force to the center press portion 14 is suppressed by the first protrusion 18, tip end of the first protrusion 18 being in contact with the switch substrate 11, and thereby the movable contact point 14A and the fixed contact points 11A are kept separated maintaining the center switch element in OFF state.

As soon as the pressure applied on the operating body 22 is withdrawn, the operating body 22 returns upward smoothly by an elastic restorative force of the third connection portion 25, and the periphery press portion 17 is also released from the pressure and returns upward to the neutral position by an elastic restorative force of the second connection portion 20.

Even if an operating pressure is exerted on the operating body 22 at a dislocated place, viz. an operating pressure intended at the center is shifted to a placed dislocated towards periphery, or an operating pressure intended at a peripheral area is shifted to a place dislocated towards the center, the operating pressure intended at the center of the operating body 12 is driven towards the center by the function of fulcrum due to the first protrusion 18, and the operating pressure intended at a peripheral area is driven likewise towards the peripheral area. Thus, a certain operating pressure can surely turn a switch element corresponding to the intended area into ON state.

As described in the above, with a multidirectional switch in accordance with the present exemplary embodiment, an operating pressure exerted on the operating body at the central area turns the center switch element into ON state, while an operating pressure exerted on the operating body at the peripheral area turns the periphery switch element into ON state, respectively. Both of the center and periphery elements are not brought into ON state at a same time, and therefore a reliable and stable switching is provided. Thus a multidirectional switch of the present invention offers a reliable and stable performance, and a greater restorative force. Such multidirectional switches can be provided at an inexpensive cost.

Figure 5:
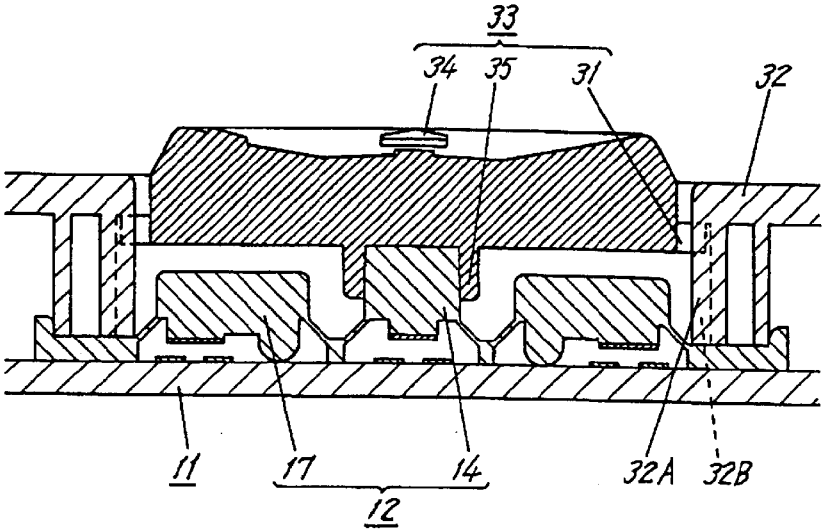
FIG. 5 is a cross sectional view of the multidirectional switch in the first embodiment, in which other type operating body is used.
Figure 6:
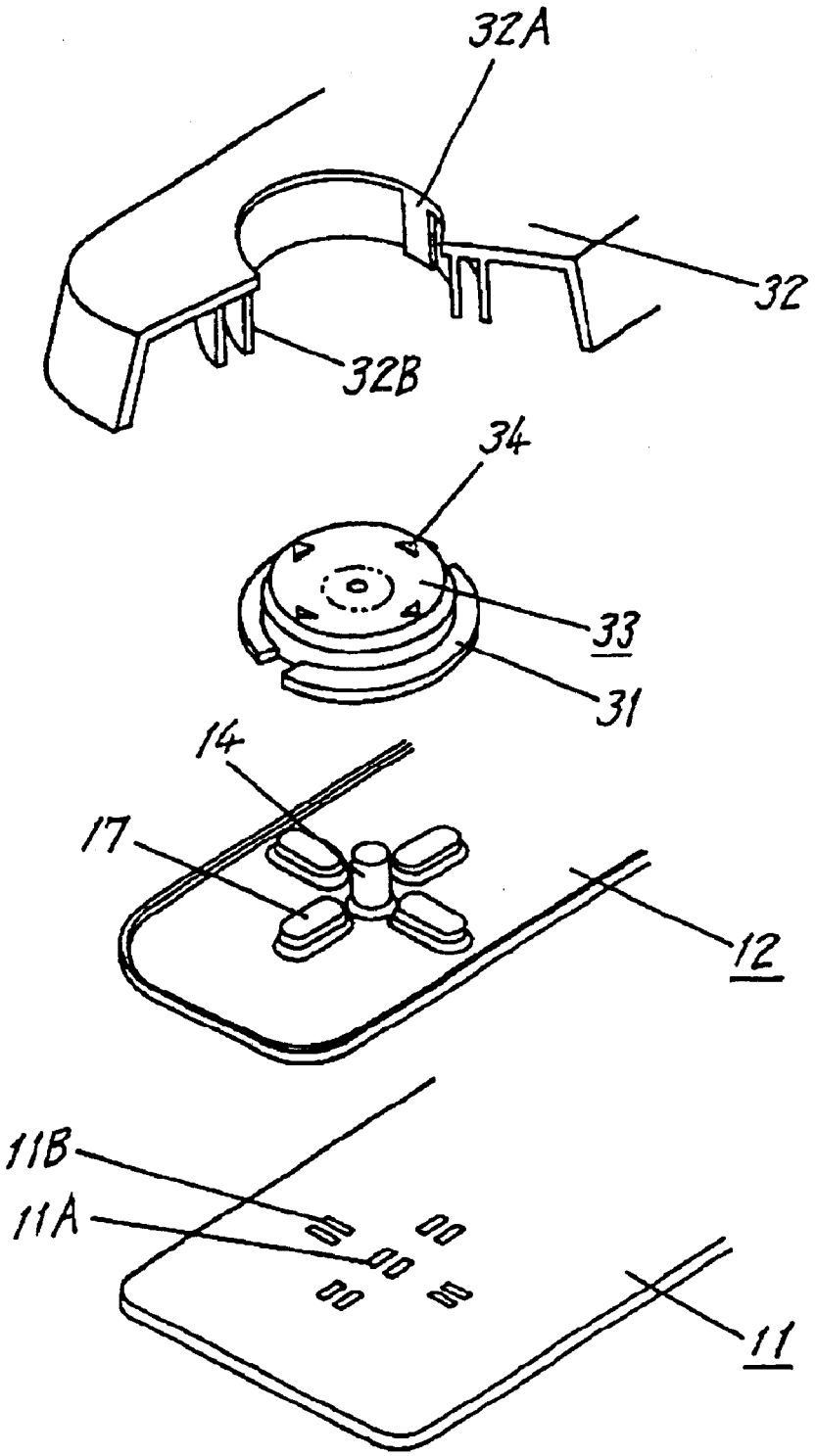
FIG. 6 is an exploded perspective view of the multidirectional switch of FIG. 5 using the other type operating body.

Although the operating body 22 has been described based on a configuration where it has a thick disc shape, made of rubber, elastomer or the like elastic material, connected at the bottom circumference with a lower-positioned circumferential rim 26 by a third connection portion 25 having a dome shape, and placed on the base portion 13, the operating body may constituted instead in a structure as shown in FIG. 5 and FIG. 6. Namely, a resin operating body 33 may be formed in a thick disc shape having a rim 31 protruding outward from the outer circumference, that is emerging upward from an opening of a resin case 32 for operation. A multidirectional switch of this configuration can also avoid the center switch element and the periphery switch element going into ON state at a same time.

The operating body 33 is provided with four direction indicating marks 34 on the upper surface, and an engagement portion 35 at the bottom center for holding the center press portion 14 of driving body 12, and the rim 31 prevents the operating body 33 from withdrawing upward away from the resin case 32. A rib 32A provided in resin case 32 prevents the operating body 33 from making revolution, and a hollow 32B is to assure a smooth up and down motion of the operating body 33.

(Embodiment 2)

Figure 7:
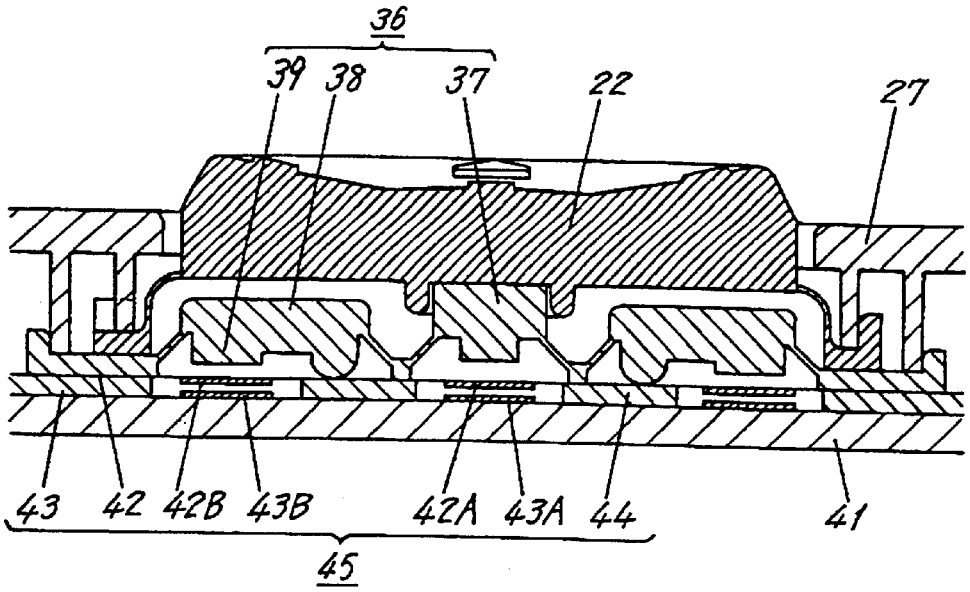
FIG. 7 is a cross sectional view of a multidirectional switch in a second exemplary embodiment of the present invention.

A multidirectional switch in a second exemplary embodiment of the present invention is described next with reference to FIG. 7. The basic structure of the present multidirectional switch remains the same as that of the multidirectional switch of embodiment 1 shown in FIG. 1; that it is formed of a resin case 27 having an opening, a driving body 12 made of an elastic material formed of a center drive portion 16, a periphery drive portion 21 and a base portion 13, an operating body 22 of a thick disc shape made of an elastic material, and other structures. The ON-OFF operation is also made likewise by pressing the operating body 22. The point of difference lies in the structure of switch elements.

Different from the multidirectional switch of embodiment 1, a multidirectional switch of the present embodiment is provided with no movable contact point on the bottom surfaces of center drive portion 16 and periphery drive portion 21. In the present embodiment, a membrane switch 45 structured of a couple of insulating substrates 42, 43 made of a polyethylene terephtharate flexible film of approximately 100 $\mu$m thick, or the like material, held together with an insulating spacer 44 interposed in between is placed on the switch substrate 41 for the center switch element and the periphery switch elements, as shown in FIG. 7. In respective regions underneath the center drive portion 16 and the periphery drive portion 21 of driving body 12, as illustrated in FIG. 1, upper contact points 42A, 42B (shown in FIG. 7) are provided on the upper flexible insulating substrate 42, and lower contact points 43A, 43B on the lower flexible insulating substrate 43 in a manner that the upper contact point and the lower contact point oppose to each other.

An operating pressure given on the operating body 22 at the center, or at a specific point in the peripheral area, makes the bottom surface of center press portion 37 of driving body 36, or second protrusion 39 of periphery press portion 38 push down the upper contact point 42A, or 42B, until the contact point reaches to make contact with the lower contact point 43A, or 43B. Thus the contact points create ON state.

The use of a membrane switch, which is formed of a couple of flexible insulating substrates held together and the opposing upper contact points and the lower contact points are contained within, increases the anti-dust capability and the contact reliability of a multidirectional switch.

(Embodiment 3)

A multidirectional switch in a third exemplary embodiment of the present invention is described next with reference to FIG. 8, FIG. 9, which is a cross sectional view of the multidirectional switch along X—X lines of FIG. 8, and FIG. 10. As shown in FIG. 9, the present multidirectional switch has been formed in a same manner as that of embodiment 1 with a substrate 11 provided with fixed contact points 11A, 11B, an operating body 22 of a thick disc shape made of an elastic material, a resin case 27 having an opening for allowing the operating body 22 to emerge upward, and other structuring members. The point of difference is in the structure of a driving body 51.

Figure 8:
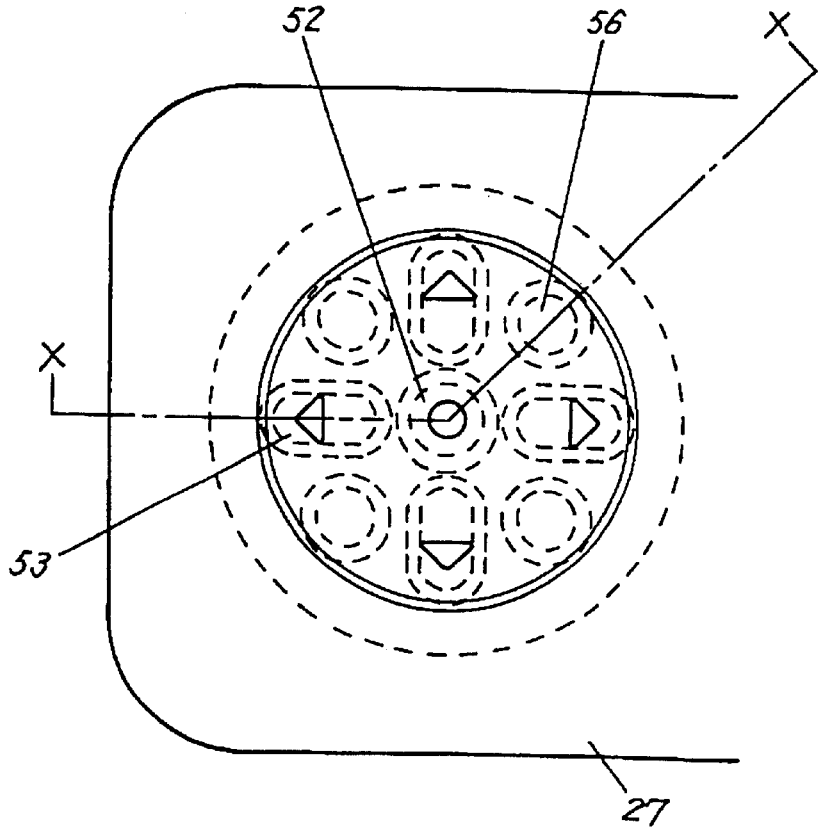
FIG. 8 is a plan view of a multidirectional switch in a third exemplary embodiment of the present invention.
Figure 9:
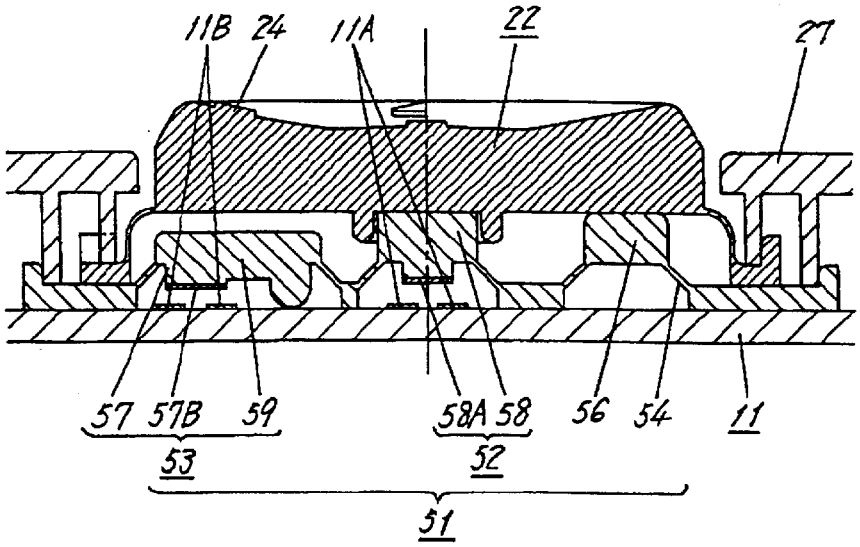
FIG. 9 is a cross sectional view of the multidirectional switch of FIG. 8, sectioned along the lines X—X.
Figure 10:
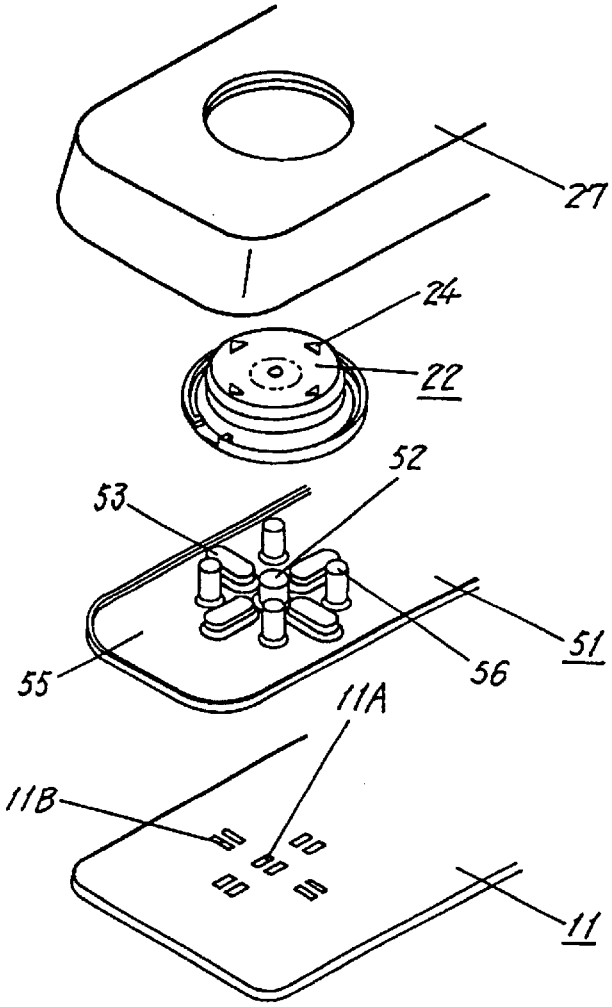
FIG. 10 is an exploded perspective view of the multidirectional switch in the third embodiment of the present invention.

As shown in FIG. 8, FIG. 9 and FIG. 10, the driving body 51 is integrally provided with a projection 56 of a thick column shape in regions at the middle of four respective periphery drive portions 53 disposed around the center drive portion 52. The projection 56 is connected at the bottom circumference with a base portion 55 of the driving body 51 by a fourth connection portion 54 having an approximate dome shape of thin wall thickness. The projection 56 is making contact at the upper surface with the bottom surface of operating body 22, and disposed so that it locates in the middle region between the respective four periphery drive portions 53 at an equal angular space of 90 degree.

In the above described structure as illustrated in FIG. 9, which shows the neutral state, when the operating body 22 is pressed at the center, the center press portion 58 of center derive portion 52 moves down, also the four projections 56 locating between the four periphery drive portions 53 sink down with the fourth connection portion 54 disposed at the bottom end flexed, and the movable contact point 58A contacts with the fixed contact points 11A. Thereby the center switch element turns into ON state.

When the operating body 22 is pressed at a point in the vicinity of one of the direction indicating marks 24, the periphery press portion 59 of periphery drive portion 53 moves down, also the projections 56 locating in both sides of the pressed periphery drive portion 53 sink down with the fourth connection portion 54 disposed at the bottom flexed, and the movable contact point 57B disposed on the bottom surface of second protrusion 57 of periphery drive portion 53 contacts with the fixed contact points 11B. Thereby the periphery switch element turns into ON state.

As soon as the pressure applied on the operating body 22 is withdrawn, the operating body 22 moves upward to the neutral position driven by, in addition to its own elastic restorative force, an elastic restorative force of the center drive portion 52, or the periphery drive portion 53, and an elastic restorative force of the fourth connection portion 54 of projection 56.

As described in the above, a multidirectional switch in the present embodiment is provided with an elastic restorative force of the projection 56, in addition to elastic force of the center drive portion 52, or periphery drive portion 53, when the operating body is pressed. The increased restorative force thus made available contributes to generate a crispy touch for an improved operational feeling.

Although the projection 56 has been provided for the same number as that of the periphery drive portions 53 in the present exemplary embodiment, the projection 56 may be provided for one place only, or for opposing two places, depending on needs.

(Embodiment 4)

Figure 11:
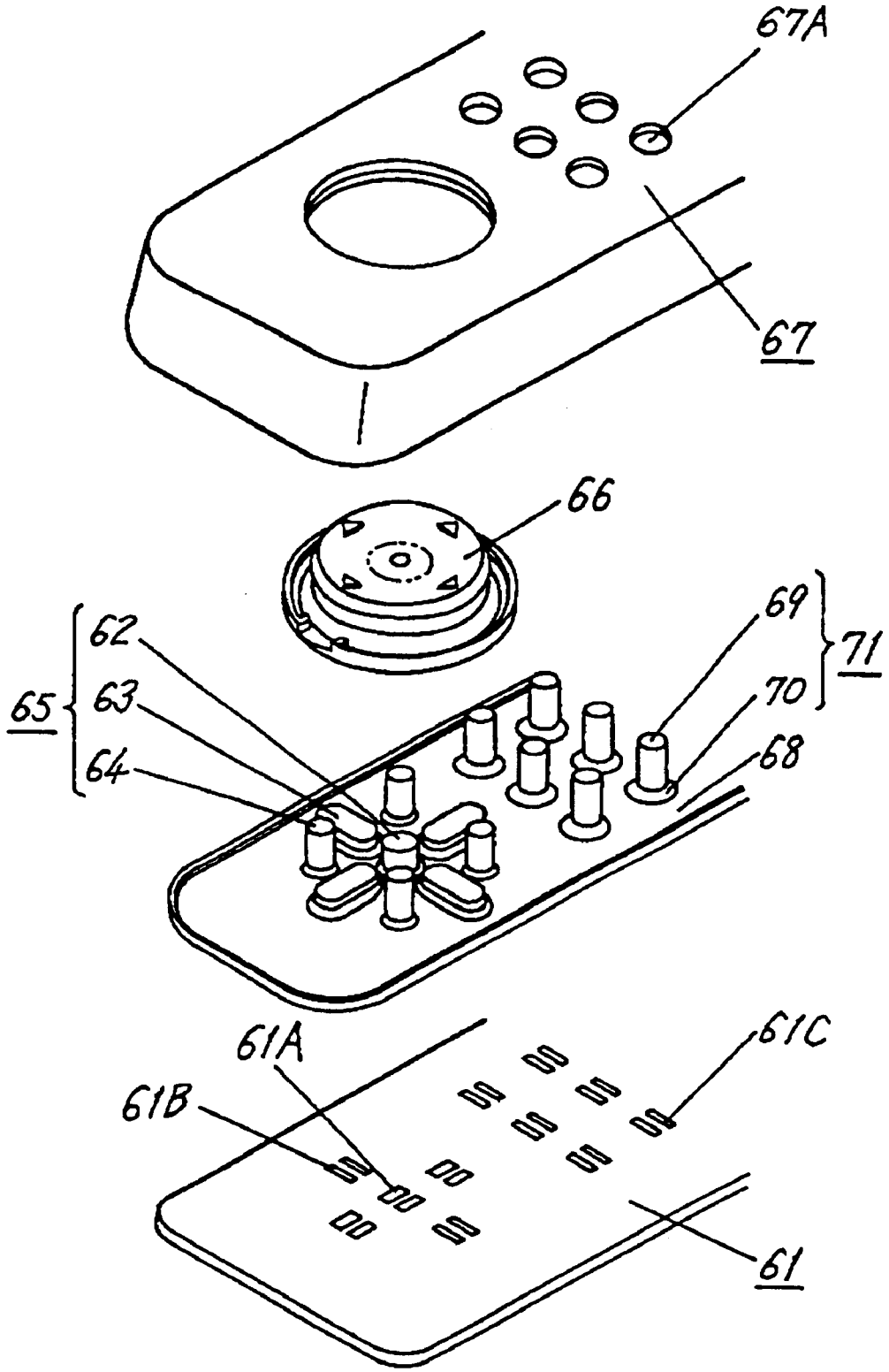
FIG. 11 is an exploded perspective view of a multidirectional switch in a fourth exemplary embodiment of the present invention.
Figure 12:
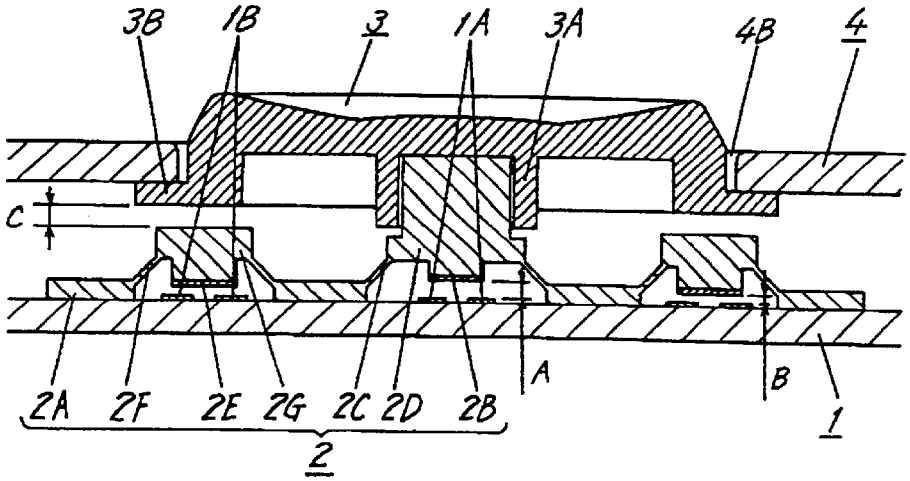
FIG. 12 PRIOR ART
FIG. 12 is a cross sectional view of a conventional multidirectional switch.
Figure 13:
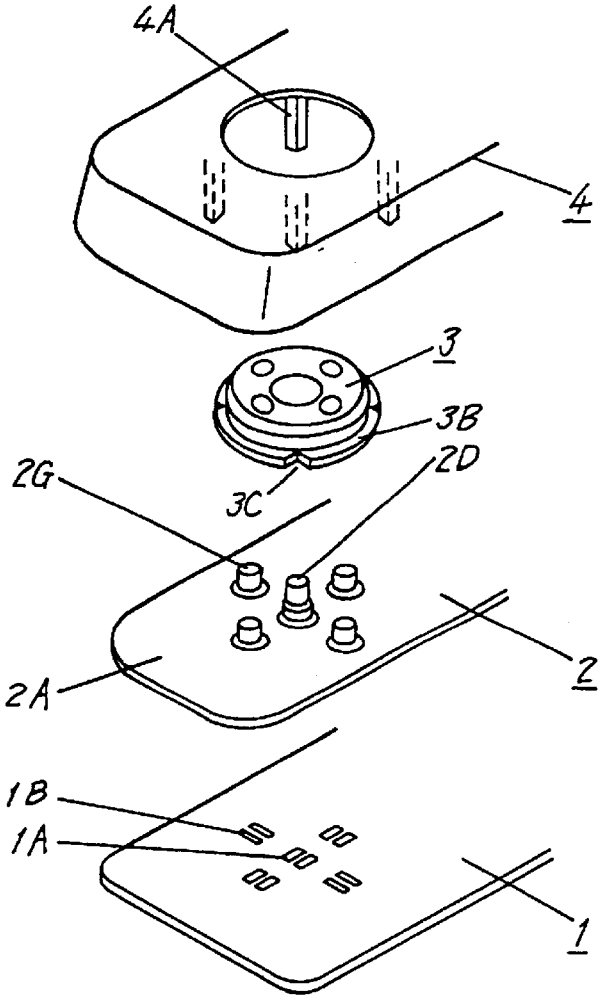
FIG. 13 PRIOR ART
FIG. 13 is an exploded perspective view of a conventional multidirectional switch.
Figure 14:
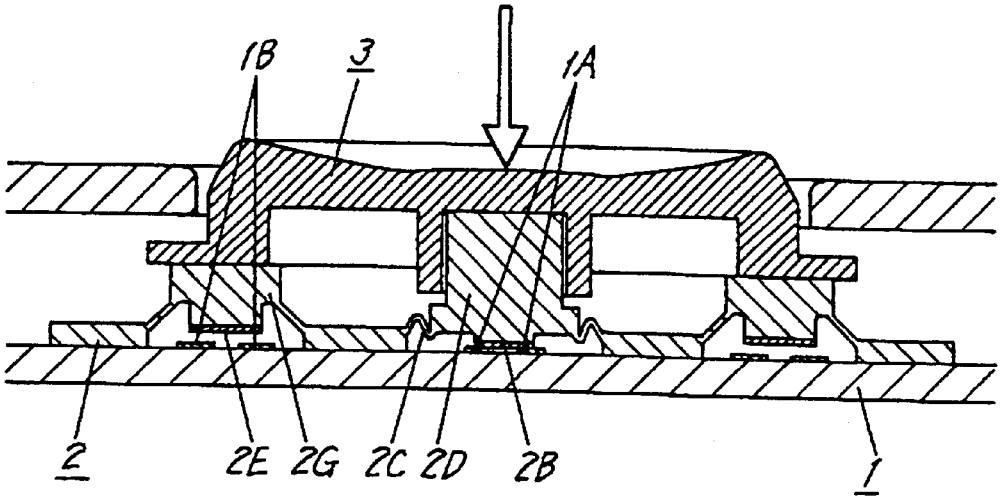
FIG. 14 PRIOR ART
FIG. 14 is a cross sectional view of the conventional multidirectional switch, in a state where the operating body is being pressed down at the center.
Figure 15:
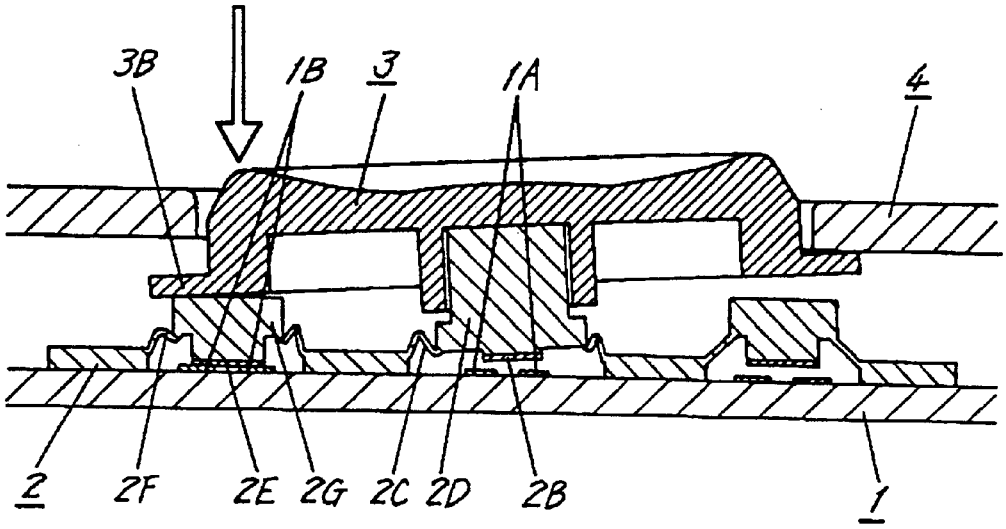
FIG. 15 PRIOR ART
FIG. 15 is a cross sectional view of the conventional multidirectional switch, in a state where the operating body is being pressed down at the periphery.

FIG. 11 shows structure of a complex type switch in accordance with a fourth exemplary embodiment of the present invention. The complex type switch differs from the multidirectional switch of embodiment 3 in that the complex type switch is provided with a plurality of push button switches on the switch substrate of the multidirectional switch.

As shown in FIG. 11, a multidirectional switch is formed in a same manner as in embodiment 3 with a switch substrate 61 provided with fixed contact points 61A, 61B, a driving body 65 formed of a center drive portion 62, periphery drive portions 63 and projections 64 each provided on a base portion 68, an operating body 66 of a thick disc shape, and a resin case 67 housing these items. On the upper surface of an extension of the base portion 68, a plurality of external press portions 69 of thick column shape are provided, which external press portion 69 is connected at the bottom circumference with the lower-positioned base portion 68 by a fifth connection portion 70 having an approximate dome shape of thin wall thickness. Thus a plurality of external drive portions 71 are integrally formed.

Upper part of the external press portions 69 are protruding above the resin case 67 through openings 67A, while each bottom surface is provided with a movable contact point (not shown). On the switch substrate 61 extending from the multidirectional switch, plural pairs of fixed contact points 61C are provided in the places corresponding to the above movable contact points. Thus a plurality of push button switches are formed.

With the above described configuration, when an external press portion 69 emerging from the opening 67A of resin case 67 is pressed, the fifth connection portion 70 flexes and the movable contact point contacts with the fixed contact points 61C, and the push button switch turns into ON state. As soon as the pressing force is withdrawn, the movable contact retracts off the fixed contact points 61C by the elastic restorative force of fifth connection portion 70, returning the switch to OFF state.

As described in the above, a driving body integrally formed of a center drive portion, a periphery drive portion and an external drive portion for one or more push button switches, and a switch substrate may be housed in a resin case in accordance with the present embodiment 4 to constitute a complex type switch. In this way, a multifunctional complex type switch may be offered in a compact profile at an inexpensive cost.

Although the above exemplary embodiments 1 through 4 have been described citing an ON-OFF switch element comprising a movable contact point formed on the bottom surface of a driving body and fixed contact points formed on the upper surface of a switch substrate, also a membrane switch element, the same effects may be created by providing a movable contact point made of a thin elastic metal plate over fixed contact points disposed on the upper surface of a switch substrate, or employing a single-body push-on switch, and having these switches pressed by a driving body at the bottom surface of a center press portion, or at the bottom surface of the second protrusion of a periphery press portion. Although a driving body having a round shape has been shown above, a driving body having a polygonal shape may be used.

What is claimed is:

1. A multidirectional switch comprising:

a center switch element and a periphery switch element positioned adjacent the center switch element;

a switch substrate having the center switch element and the periphery switch element disposed thereon;

a driving body disposed above the switch substrate, having a center press portion opposing the center switch element and a periphery press portion opposing the periphery switch element, said periphery press portion having a bottom surface comprising a first section operative for effecting activation of said periphery switch element, and a second section;

an operating body for pressing the center press portion and the periphery press portion, and a first protrusion provided on said second section of the periphery press portion, said first protrusion extending in a downward direction.

2. The multidirectional switch according to claim 1, wherein said driving body further comprises a base portion disposed on the switch substrate, a first connection portion for connecting a circumference of the center press portion with the base portion, and a second connection portion for connecting a circumference of the periphery press portion with the base portion.

3. The multidirectional switch according to claim 2, wherein said operating body comprises a main body, a circumferential rim provided outside of the main body and a third connection portion for connecting the circumferential rim with a circumference of the main body, and the circumferential rim is mounted on the base portion.

4. The multidirectional switch according to claim 2, wherein said driving body further comprises a projection disposed at a vicinity of the periphery press portion and a fourth connection portion for connecting a circumference of the projection with the base portion, and an upper surface of the projection contacts with a bottom surface of the operating body.

5. The multidirectional switch according to claim 4, wherein said multidirectional switch comprises a plurality of said periphery press portions.

6. The multidirectional switch according to claim 1, wherein said operating body comprises a main body, a circumferential rim provided outside of the main body and a third connection portion for connecting the circumferential rim with a circumference of the main body.

7. The multidirectional switch according to claim 1, wherein a second protrusion is provided on said first section of said bottom surface of the periphery press portion, the center switch element comprises a pair of center fixed contact points disposed on the switch substrate and a center movable contact point disposed on a bottom surface of the center press portion to oppose to the pair of center fixed contact points, and the periphery switch element comprises a pair of periphery fixed contact points disposed on the switch substrate and a periphery movable contact point disposed on a bottom surface of a second protrusion to oppose to the pair of periphery fixed contact points.

8. The multidirectional switch according to claim 1, wherein a flexible insulating substrate is disposed above the switch substrate, the center switch element comprises a lower center contact point disposed on the switch substrate and an upper center contact point disposed on a bottom surface of the flexible insulating substrate to oppose to the lower center contact point, and the periphery switch element comprises a lower periphery contact point disposed on the switch substrate and an upper periphery contact point disposed on a bottom surface of the flexible insulating substrate to oppose to the upper periphery contact point.

9. The multidirectional switch according to claim 1, wherein a first and second flexible insulating substrates are disposed above the switch substrate, the center switch element comprises a lower center contact point disposed on the first flexible insulating substrate and an upper center contact point disposed on a bottom surface of the second flexible insulating substrate to oppose to the lower center contact point, and the periphery switch element comprises a lower periphery contact point disposed on the first flexible insulating substrate and an upper periphery contact point disposed on a bottom surface of the second flexible insulating substrate to oppose to the upper periphery contact point.

10. The multidirectional switch of claim 1, wherein said first protrusion contacts said switch substrate when said operating body is in an at-rest position.

11. The multidirectional switch of claim 1, wherein said first protrusion is operative for inhibiting the simultaneous activation of the center switch element and the periphery switch element.

12. A multidirectional switch comprising:

a center switch element, and a plurality of periphery switch elements disposed radially around the center switch element at positions with equivalent distances from the center switch element, the center switch element and the plurality of periphery switch elements being activated by exerting a downward pressing force thereon;

a switch substrate having the center switch element and the plurality of periphery switch elements disposed thereon;

a driving body including a base portion mounted on the switch substrate, a center press portion having a column shape disposed opposite to the center switch element with a predetermined clearance, a first connection portion for connecting a circumference of the center press portion with the base portion, a plurality of periphery press portions, each having an oblong shape and disposed opposite to each of the plurality of periphery switch elements with a predetermined clearance, and a plurality of second connection portions, each for connecting a circumference of each of the plurality of periphery press portions with the base portion; and an operation body having a round shape or a polygonal shape disposed above the driving body, said operation body having a predetermined clearance from the plurality of periphery press portions with said operation body in an at-rest position, said operation body including an engagement portion provided in a middle of a bottom surface of the operation body to contact with the center press portion, wherein each of the plurality of periphery press portions includes a first protrusion having an end contacting with the switch substrate and a second protrusion having a flat end opposing to one of the plurality of periphery switch elements with a predetermined clearance, on a bottom surface thereof.

13. A complex type switch comprising a multidirectional switch and a push button switch, wherein said multidirectional switch comprises:

a center switch element and a periphery switch element positioning around the center switch element;

a switch substrate having the center switch element and the periphery switch element disposed thereon;

a driving body disposed above the switch substrate, having a center press portion opposing the center switch element and a periphery press portion opposing the periphery switch element, said periphery press portion having a bottom surface comprising a first section operative for effecting activation of said periphery switch element and a second section having a first protrusion disposed thereon, said first protrusion extending in the downward direction, an operating body for pressing the center press portion and the periphery press portion, and said push button switch comprises:

a switch element provided on an extension of the switch substrate; and an external press portion disposed above the switch element.

14. The complex type switch according to claim 13, wherein said driving body further comprises a base portion disposed on the switch substrate, a first connection portion for connecting a circumference of the center press portion with the base portion, and a second connection portion for connecting a circumference of the periphery press portion with the base portion.

15. The complex type switch according to claim 14, wherein said operating body comprises a main body, a circumferential rim provided outside of the main body and a third connection portion for connecting the circumferential rim with a circumference of the main body, and the circumferential rim is mounted on the base portion.

16. The complex type switch according to claim 14, wherein said driving body further comprises a projection disposed at a vicinity of the periphery press portion and a fourth connection portion for connecting a circumference of the projection with the base portion, and an upper surface of the projection contacts with a bottom surface of the operating body.

17. The complex type switch according to claim 16, wherein said multidirectional switch comprises a plurality of said periphery press portions.

18. The complex type switch according to claim 14, wherein said push button switch further comprises a fifth connection portion for connecting a circumference of the external press portion with the base portion.

19. The complex type switch according to claim 13, wherein said operating body comprises a main body, a circumferential rim provided outside of the main body and a third connection portion for connecting the circumferential rim with a circumference of the main body.

20. The complex type switch according to claim 13, wherein a second protrusion is provided on said first section of said bottom surface of the periphery press portion, the center switch element comprises a pair of center fixed contact points disposed on the switch substrate and a center movable contact point disposed on a bottom surface of the center press portion to oppose the pair of center fixed contact points, and the periphery switch element comprises a pair of periphery fixed contact points disposed on the switch substrate and a periphery movable contact point disposed on a bottom surface of the second protrusion to oppose the pair of periphery fixed contact points.

21. The complex type switch according to claim 13, wherein a flexible insulating substrate is disposed above the switch substrate, the center switch element comprises a lower center contact point disposed on the switch substrate and an upper center contact point disposed on a bottom surface of the flexible insulating substrate to oppose to the lower center contact point, and the periphery switch element comprises a lower periphery contact point disposed on the switch substrate and an upper periphery contact point disposed on a bottom surface of the flexible insulating substrate to oppose to the upper periphery contact point.

22. The complex type switch according to claim 13, wherein a first and second flexible insulating substrates are disposed above the switch substrate, the center switch element comprises a lower center contact point disposed on the first flexible insulating substrate and an upper center contact point disposed on a bottom surface of the second flexible insulating substrate to oppose to the lower center contact point, and the periphery switch element comprises a lower periphery contact point disposed on the first flexible insulating substrate and an upper periphery contact point disposed on a bottom surface of the second flexible insulating substrate to oppose to the upper periphery contact point.

* * * * *